United States Patent [19]

Michel

[11] 4,276,987

[45] Jul. 7, 1981

[54] HOLLOW BODY MADE OF AN ORIENTED THERMOPLASTIC

[75] Inventor: Edmond Michel, Brussels, Belgium

[73] Assignee: Solvay & Cie, Brussels, Belgium

[21] Appl. No.: 113,264

[22] Filed: Jan. 18, 1980

[30] Foreign Application Priority Data

Feb. 7, 1979 [FR] France ..... 79 03414

[51] Int. Cl.[3] ..... B65D 1/02

[52] U.S. Cl. ..... 215/1 C; 215/10

[58] Field of Search ..... 215/1 C, 10

[56] References Cited

U.S. PATENT DOCUMENTS

| | | | |
|---|---|---|---|
| 3,043,461 | 7/1962 | Glassco | 215/1 C |
| 3,757,978 | 9/1973 | Gilbert | 215/1 C |
| 3,759,410 | 9/1973 | Uhlig | 215/1 C |
| 3,870,181 | 3/1975 | Sincock | 215/1 C |
| 4,174,782 | 11/1979 | Obsomer | 215/1 C |

FOREIGN PATENT DOCUMENTS 2391918 12/1978 France .

*Primary Examiner*—Donald F. Norton
*Attorney, Agent, or Firm*—Spencer & Kaye

[57] ABSTRACT

Hollow body made of an oriented thermoplastic, such as bottles, the base of which comprises a central part 4 in the form of an inset dome, which central part is joined to the side wall 2 by means of a peripheral arched moulding 3, in which hollow body the central part is provided with a plurality of hollow protuberances 6 which project outwards from the hollow body and are distributed around its longitudinal axis C–C', the protuberances 6 having the appearance of cones, the rounded vertices of which are separated from the longitudinal axis of the hollow body by a distance which is equal to at most 60% of the external diameter of the neck of the hollow body.

13 Claims, 4 Drawing Figures

HOLLOW BODY MADE OF AN ORIENTED THERMOPLASTIC

The present invention relates to a hollow body made of a bioriented thermoplastic, which has a longitudinal axis of symmetry and possesses a cylindrical neck, a side wall of general cylindrical shape and a base which comprises a central part in the form of an inset dome, which central part is joined to the side wall by means of an arched peripheral moulding forming a bearing surface for the hollow body, such as a bottle or an analogous container, when the latter is in the vertical position.

At the present time, it is becoming increasingly common to use thermoplastics to produce hollow bodies such as bottles used for packaging liquids. In order to increase the mechanical strength of the hollow bodies, it is becoming increasingly common to blow-mould them under conditions, in particular temperature conditions, which lead to the orientation, and preferably to the biorientation in two orthogonal directions, of the macromolecules of their constituent material.

The choice, for these hollow bodies, of a base possessing a central part in the form of an inset dome, which central part is joined to the side wall by means of a peripheral arched moulding which enables the hollow body to stand in the vertical position, is generally determined with a view to improving the stability of the hollow bodies in the vertical position and the impact strength of these hollow bodies. In general, the diameter of the central part in the form of an inset dome varies between 30 and 80% of the value of the maximum diameter of the hollow bodies so as to guarantee a good impact strength.

However, hollow bodies of this type exhibit a serious disadvantage which results from the fact that the diameter of the insert part of their base is generally greater than the external diameter of their neck, whereupon the latter can penetrate substantially into the inset part of the base of a similar hollow body. Thus, when these hollow bodies are packed in cardboard cases, after they have been filled, and the said cases are then stacked ready for transportation or storage, the cardboard walls placed between two superposed tiers of hollow bodies, that is to say the lower and upper walls of the cases, are likely to be deformed, by compression, between the necks and the bases of these hollow bodies, in particular when these walls are wet. This therefore results in deformation of the packing cases, which is likely to jeopardise the stability of the stacks.

After numerous experiments, a special design for this type of base, for a hollow body, has now been found which makes it possible to overcome this disadvantage whilst at the same time retaining, and even improving, the other advantageous properties and in particular the impact strength.

The present invention thus relates to a hollow body made of an oriented thermoplastic, which has a longitudinal axis of symmetry and possesses a cylindrical neck, a side wall of general cylindrical shape and a base which comprises a central part in the form of an inset dome, which central part is joined to the side wall by means of an arched peripheral moulding forming a bearing surface for the hollow body in the vertical position, in which hollow body the central part in the form of an inset dome is provided with a plurality of protuberances which project outwards from the hollow body, which are distributed around the longitudinal axis, and the tops of which are separated from this axis by a distance which is equal to at most 60% of the external diameter of the neck of the hollow body.

Preferably, these protuberances are hollow and are produced directly during moulding by using a suitable mould.

In fact, it has been found that, contrary to all expectations, the presence of these protuberances does not affect the impact strength of the hollow body and that, on the contrary, it can even improve the impact strength. Moreover, the presence of these protuberances prevents, or at least severely restricts, the possibility of the neck of one hollow body penetrating into the inset part of the base of a similar hollow body and therefore eliminates the risk of deformation of the cardboard walls of the cases used for placing the hollow bodies in groups and packing them.

For maximum certainty of achieving this result, it is generally preferred that the tops of the protuberances be separated from the longitudinal axis of the hollow body by a distance which is equal to at most 50% of the external diameter of the neck of the hollow body, this separation being the same for each top.

The protuberances can possess any profile but are preferably devoid of sharp angles. In a preferred embodiment, the protuberances have the appearance of cones with a rounded vertex, the longitudinal axes or directrices of which cones are parallel to, or directed towards, the longitudinal axis of the hollow body. In the latter case, the protuberances are close to this axis. In general, the base of these conical profiles is truncated because of the inclination of the inset central part of the base of the hollow body. However, it is permissible to flatten the inset central part of the base of the hollow body, at the level of the protuberances, in order to impart a perfectly conical shape to the protuberances.

The cross-sections of the protuberances can have a circular shape, as in the case where the protuberances have a conical profile, or they can have a different shape. Likewise, these sections can be constant or can vary over the whole height of the protuberances. However, the largest width of these sections is preferably less than 20% of the maximum diameter of the hollow body, the best results being achieved in the case where this width is between 5 and 15% of this diameter.

The height of the protuberances is chosen so that the tops of these protuberances are separated from the wall of the inset central part of the base in the region where the said central part is joined to the arched peripheral moulding. Moreover, this height is preferably chosen so that the tops of the protuberances are slightly set back from the bearing surface of the hollow body in the vertical position. Preferably, this offset is equal to at most 10% of the maximum diameter of the hollow body and is the same for all the protuberances.

There may be any number of protuberances. In general, however, this number preferably varies between 2 and 6. Very good results have been obtained with bases possessing three protuberances.

Likewise, the angular separation between successive protuberances is preferably constant. Thus, according to the preferred embodiments of the invention, the tops of the protuberances are located on one and the same diameter of the hollow body in the case where the base possesses two protuberances, and the tops of the protuberances define the apices of a regular polygon which can be inscribed in a circle, the centre of which is located on the longitudinal axis of the hollow body, in the case where the base is provided with more than two protuberances. However, the intended result can nevertheless be achieved when the angular separation between successive protuberances is arbitrary and variable.

The arched peripheral moulding which enables the hollow body to stand can also be produced in accordance with numerous possible methods.

According to a first possible embodiment, the arched peripheral moulding has a constant radius of curvature which joins tangentially with the side wall and with the central part of the base. In this case, the radius of curvature is generally between 10 and 25% of the maximum diameter of the hollow body.

According to a second possible embodiment, the peripheral arched moulding can have two successive constant radii of curvature. In this case, the first radius of curvature corresponds to that part of the moulding which is joined to the side wall, and is greater than the second radius of curvature, which corresponds to that part of the moulding which is joined to the central part of the base. These two successive radii of curvature are preferably chosen so that the peripheral moulding does not possess a point of inflection and so that it joins tangentially on either side with the side wall and with the central part of the base. The value of the first radius of curvature is preferably between 50 and 200% of the maximum diameter of the hollow body, and the value of the second radius of curvature is preferably between 10 and 25% of this same diameter.

However, the peripheral moulding can have other profiles than the two which have now been described. In particular, this moulding can have a variable radius of curvature.

It is also permissible to provide a virtually plane annular zone on this moulding, which zone can be use for embossing inscriptions indicating, for example, the capacity of the hollow body, the commercial name of its producer on its user, a trademark or a warning. The width of such an annular zone is generally between 10 and 40% of the maximum diameter of the hollow body and preferably between 15 and 30% of this diameter.

The central part in the form of an inset dome can have any general shape; for example, it can be frustoconical and spherical at its top. However, the preferred shape is that of a portion of a sphere. The largest diameter of this inset central part is generally between 15 and 60% of the maximum diameter of the hollow body.

As already stated, the hollow body according to the invention possesses a side wall of cylindrical shape. However, it is not necessary for this wall to have a perfect symmetry of revolution. It is possible for the shape of this wall to deviate from the shape of a perfect cylinder. Thus, the hollow body can have an elliptical or polygonal section. In this case, the largest dimension of the sections perpendicular to the axis of the hollow body preferably does not exceed twice the smallest dimension.

The hollow body according to the invention can be produced from any thermoplastic. Examples which may be mentioned of thermoplastics which can be used are resins based on vinyl chloride, polymers and copolymers produced from alpha-olefines containing up to eight carbon atoms in their molecule, acrylic polymers and copolymers, and in particular those produced from acrylonitrile, polyesters, such as poly-(ethylene glycol) terephthalate, and polycarbonates.

The hollow body according to the invention can be produced by any known technique, in particular by the technique of moulding by injection/blowing and the technique of moulding by extrusion/blowing, which leads to the production of molecularly oriented hollow bodies.

The hollow bodies according to the invention possess remarkable mechanical properties which even make them suitable for use in packaging fizzy drinks, such as beer and lemonades, under pressure.

The thermoplastic hollow body according to the invention is furthermore illustrated by FIGS. 1 and 2 of the attached drawings which show a hollow body according to an embodiment of the invention.

In these drawings, which are given purely by way of illustration:

Figure 1:
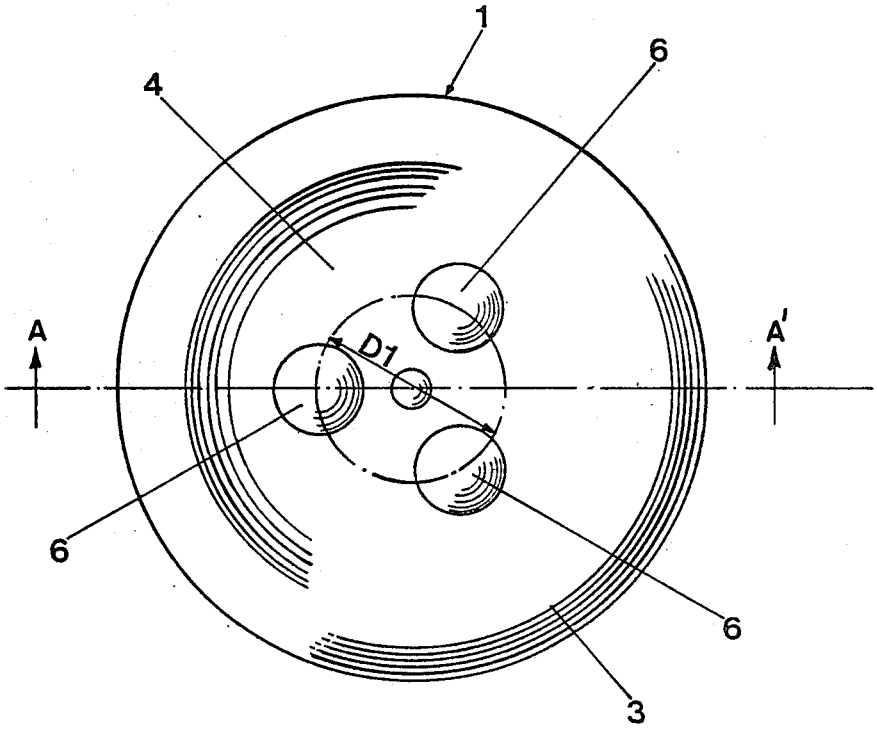
FIG. 1 is a bottom view of a hollow body according to the invention.
Figure 2:
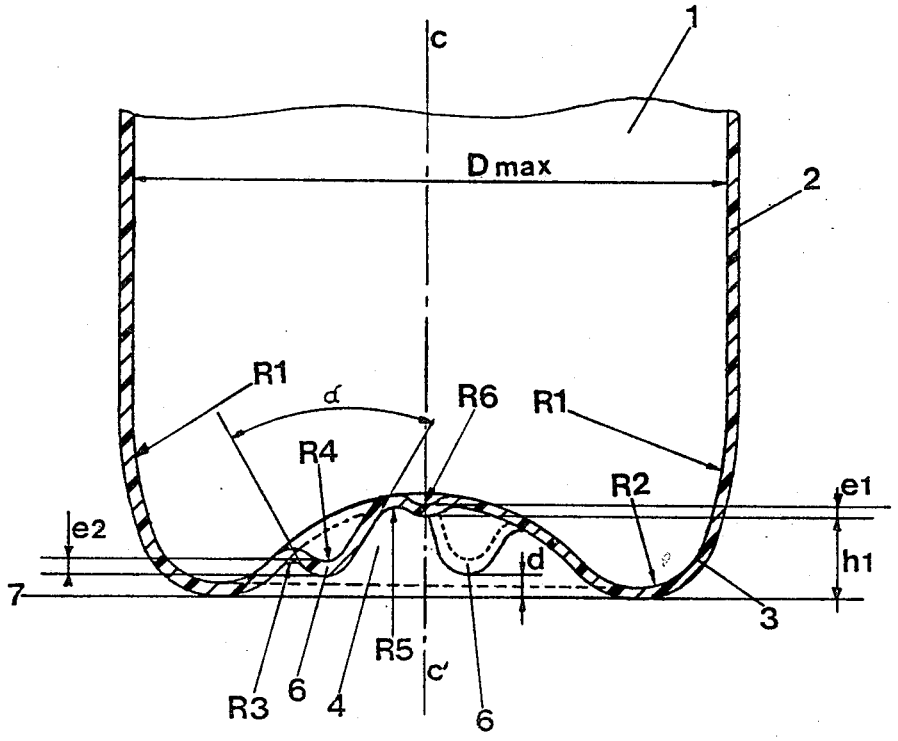
FIG. 2 is a partial view, in elevation and in section, along the axis AA' of FIG. 1.

As is apparent from FIGS. 1 and 2, the hollow body 1 according to the invention possesses a side wall 2 of general cylindrical shape, a threaded or unthreaded neck (not shown) and a base which consists of a central part 4 in the form of an inset dome, which central part is joined to the side wall 2 by means of an arched peripheral moulding 3. The arched moulding 3 has two different radii of curvature $R_1$ and $R_2$, the radius $R_1$ being substantially greater than the radius $R_2$.

According to the invention, the central part 4 is provided with three protuberances 6 which are hollow and equidistant and which are formed during the moulding of the hollow body 1. These protuberances have the general shape of a cone with a rounded vertex, the longitudinal axis of which cone is parallel to the longitudinal axis CC' of the hollow body. Moreover, the top of the protuberances is separated from the wall of the inset part 4 of the base in the region 5 in which the said part is joined to the peripheral moulding 3.

The height of the protuberances is such that the top of these protuberances is separated from the bearing surface 7 of the hollow body 1, in the vertical position, by a distance d which is equal to at most 10% of the maximum diameter, D max., of the hollow body.

The tops of the protuberances define the apices of an equilateral triangle inscribed in a circle, the centre of which is located on the longitudinal axis CC' of the hollow body 1.

Figure 3:
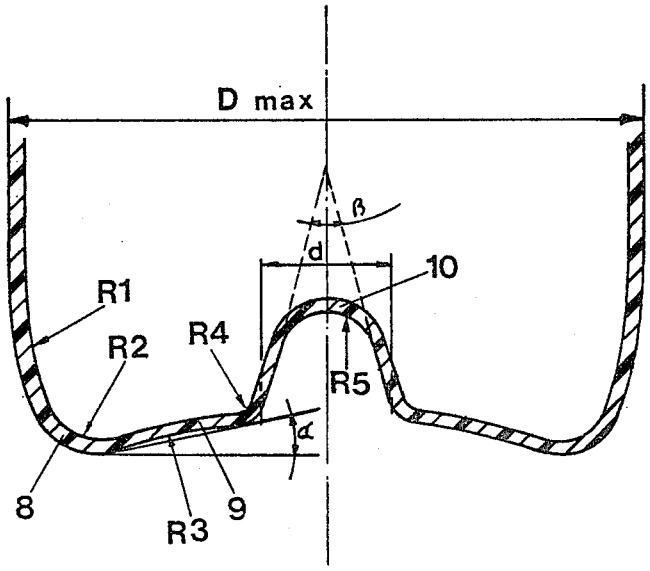
FIG 3 PRIOR ART
FIGS. 3 and 4 are views similar to that of FIG. 2 of two bodies according to the prior art.
Figure 4:
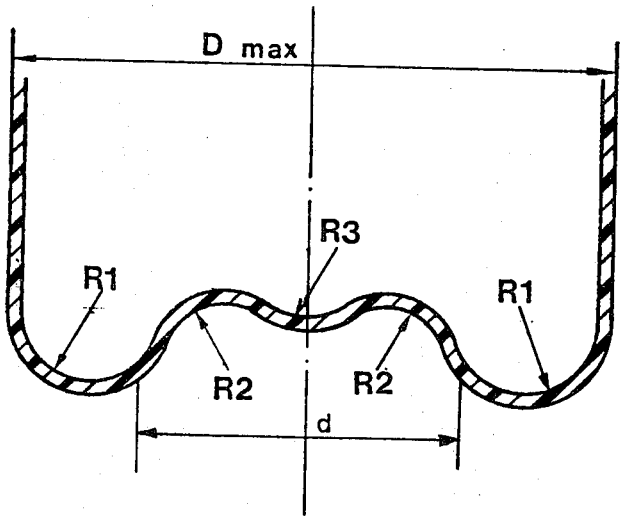
FIG 4 PRIOR ART

In order to show more clearly the advantages gained by virtue of the hollow body according to the invention, three series of oriented flasks having a capacity of 1.5 liters were produced and were provided with a base according to FIGS. 1 and 2, that is to say with a base according to the invention, or with other bases shown in FIGS. 3 or 4 of the attached drawings. These latter bases are excluded from the scope of the invention. The thermoplastic employed is rigid polyvinyl chloride. The operating conditions, in particular the parameters governing the orientation, are the same for the three series of flasks.

The principal dimensions of the bases of hollow bodies produced according to FIGS. 1 to 4 are given below.

FIGS. 1 and 2

-continued

| | | |
|---|---|---|
| D max. = 88.7 mm | $D_1$ = 32 mm | $e_1$ = 1 mm |
| $R_1$ = 100 mm | $R_3$ = 1.5 mm | $e_2$ = 3.5 mm |
| $R_2$ = 12 mm | $R_4$ = 5 mm | $h_1$ = 15 mm |
| d = 4.5 mm | $R_5$ = 3.5 mm | $\alpha$ = 60° |
| | $R_6$ = 4 mm | |
| FIG. 3 | | |
| D max. = 88.7 mm | $R_4$ = 7 mm | |
| $R_1$ = 100 mm | $R_5$ = 9 mm | |
| $R_2$ = 12 mm | d = 30 mm | |
| $R_3$ = 150 mm | $\alpha$ = 10° | |
| | $\beta$ = 30° | |
| FIG. 4 | | |
| $R_1$ = 13 mm | D max. = 88.7 mm | |
| $R_2$ = 10 mm | d = 50 mm | |
| $R_3$ = 10 mm | | |

Starting from the periphery, the base according to FIG. 3 successively consists of a peripheral arched moulding 8 for joining the base to the side wall, of an essentially plane annular zone 9 joined to the peripheral arched moulding, and of a central part 10 in the form of an inset dome of relatively small diameter.

The base according to FIG. 4 consists of three alternate successive mouldings of constant radius.

Series of flasks obtained in this way are then filled and sealed in an identical manner before being subjected, at 15° C., to the two impact strength tests described below.

In a first test, the filled flasks are dropped in the vertical position onto a concrete bed inclined at 5°, relative to the horizontal, the drop height being 0.70 m or 1.10 m. This test makes it possible to assess the strength of the flasks in the event of an accidental fall from a table or a display shelf.

In the second test, the flask is attached to the end of a pendulum and strikes a vertical concrete wall with a potential energy of 14.710 Nm. This test makes it possible to assess the strength of the flasks in the event of accidental shocks such as, for example, those caused by the coupling of the railway wagons used for transporting them to the distribution points.

The results recorded in these tests are shown in Table 1 below. The numbers indicated opposite the two types of test give the number of flasks broken out of 100 flasks subjected to the test.

TABLE 1

| | BASE ACCORDING TO | | |
|---|---|---|---|
| TEST | FIGS. 1 and 2 | FIG. 3 | FIG. 4 |
| 1st test height: 0.70 m | 0 | 0 | 15 |
| height: 1.10 m | 2 | 20 | 60 |
| 2nd test | 15 | 30 | 65 |

It is immediately seen that the flasks according to the invention (FIGS. 1 and 2) possess a substantially improved impact strength.

Furthermore, flasks filled and sealed according to the invention are placed in groups of 12 in cardboard cases normally used for their storage and transportation. The cases are then stacked four deep. After storage for 60 days, no deformation is found in the lower and upper faces of the cardboard cases.

I claim:

1. Hollow body made of an oriented thermoplastic, which has a longitudinal axis of symmetry and possesses a cylindrical neck, a side wall of general cylindrical shape and a base which comprises a central part in the form of an inset dome, which central part is joined to the side wall by means of an arched peripheral moulding forming a bearing surface for the hollow body in the vertical position, and is provided with a plurality of hollow protuberances which project outwards from the hollow body and are distributed about its longitudinal axis, characterised in that the protuberances have the appearance of cones with a rounded vertex and have tops which are separated from the longitudinal axis of the hollow body by a distance which is equal to at most 60% of the external diameter of the neck of the hollow body.

2. Hollow body according to claim 1, characterized in that the longitudinal axes of the protuberances are parallel to the longitudinal axis of the hollow body.

3. Hollow body according to claim 1, characterized in that the longitudinal axes of the protuberances are directed towards the longitudinal axis of the hollow body, and in that the protuberances are close to the said axis.

4. Hollow body according to any one of claims 1 to 3, characterised in that the greatest width of the cross-sections of the protuberances is less than 20% of the maximum diameter of the hollow body.

5. Hollow body according to claim 4, characterised in that the height of the protuberances is such that the top of the protuberances is set back from the bearing surface of the hollow body, in the vertical position, by a distance which is equal to at most 10% of the maximum diameter of the hollow body.

6. Hollow body according to claim 5, characterised in that it possesses from 2 to 6 protuberances.

7. Hollow body according to claim 6, characterised in that the angular separation between successive protuberances is constant.

8. Hollow body according to claim 5, characterised in that the angular separation between successive protuberances is constant.

9. Hollow body according to claim 4, characterised in that the angular separation between successive protuberances is constant.

10. Hollow body according to any one of claims 1 to 3, characterised in that the angular separation between successive protuberances is constant.

11. Hollow body according to claim 4, characterised in that it possesses from 2 to 6 protuberances.

12. Hollow body according to any one of claims 1 to 3, characterised in that it possesses from 2 to 6 protuberances.

13. Hollow body according to any one of claims 1 to 3, characterised in that the height of the protuberances is such that the top of the protuberances is set back from the bearing surface of the hollow body, in the vertical position, by a distance which is equal to at most 10% of the maximum diameter of the hollow body.

* * * * *